United States Patent [19]

Shier

[11] 4,289,056

[45] Sep. 15, 1981

[54] PERCUSSION KIT

[76] Inventor: Stephen F. Shier, 18 Cressy Ave., Windsor Gardens, Australia, 5087

[21] Appl. No.: 78,750

[22] Filed: Sep. 25, 1979

[30] Foreign Application Priority Data

Sep. 28, 1978 [AU] Australia ..... PD6148

[51] Int. Cl.[3] ..... G10D 13/02

[52] U.S. Cl. ..... 84/412

[58] Field of Search ..... 84/411 R, 411 A, 412, 84/420

[56] References Cited

U.S. PATENT DOCUMENTS 635,192 10/1899 Sapp ..... 84/411 A 881,109 3/1908 Cipar ..... 84/412

FOREIGN PATENT DOCUMENTS 2263995 7/1974 Fed. Rep. of Germany ..... 84/412

*Primary Examiner*—Lawrence R. Franklin

*Attorney, Agent, or Firm*—Oldham, Oldham, Hudak & Weber

[57] ABSTRACT

A collapsible drum, the drum having flexible side walls formed of a pair of generally parallel walls, the walls being adapted to be inflated to hold the drum in erected condition and deflated to allow the drum to collapse for transportation and storage.

4 Claims, 3 Drawing Figures

PERCUSSION KIT

This invention relates to an improved percussion kit, and more particularly to a percussion kit which can be readily collapsed for transporting and storage, and re-erected as desired.

BACKGROUND OF THE INVENTION

One of the problems with percussion kits, particularly what may be called a full set of drums is the large volume that is occupied by the drums during storage and transportation.

Collapsible drums are known which collapse so that the drum ends move towards each other. U.S. Pat. No. 1,214,171 shows such a drum where the drum wall between the two ends is flexible with the ends interconnected by a plurality of pivoted ribs which are collapsed by radial inward pressure applied by a circling strap.

A further drum is shown in U.S. Pat. No. 1,113,253, the wall of the drum comprising flexible material, the two ends being held in spaced relation by removable spacing bars and retaining the flexible material in a taut condition.

U.S. Pat. Nos. 2,546,452 and 1,768,438 show drums where the walls are composed of a plurality of rigid telescoping rings having interengaging means to limit their relative movements.

These drums however have the disadvantage in that the air space in the drum is either not cylindrical, or has fixed members across the air space and thus these tend to interfere with the vibrations of the air within the drum space.

BRIEF DESCRIPTION OF THE INVENTION

It is an object of this invention to provide a percussion kit which can be collapsed to a smaller volume, and readily re-erected as desired.

Thus there is provided according to one aspect of the invention a percussion instrument wherein the instrument provides an upper playing surface, and a lower portion, and inflatable wall means connecting the upper playing surface and lower portion so that the upper surface and lower portion can be collapsed towards each other for transportation and storage, and re-erected to the desired spacing when it is desired to play the instrument.

With percussion instruments, it is a requirement for the effective tone and volume of the sound produced that there be a volume of air which is placed in motion by the skin which is played by the drum stick or sticks, this volume being determined by the dimensions of the drum both its diameter and length.

Thus as the drum is in its erected condition to be of a condition which can be satisfactorily played, that the means for allowing the drum to be collapsed in size for storage and transportation must be such that it does not interfere with the satisfactory playing of the drum.

Figure 1:
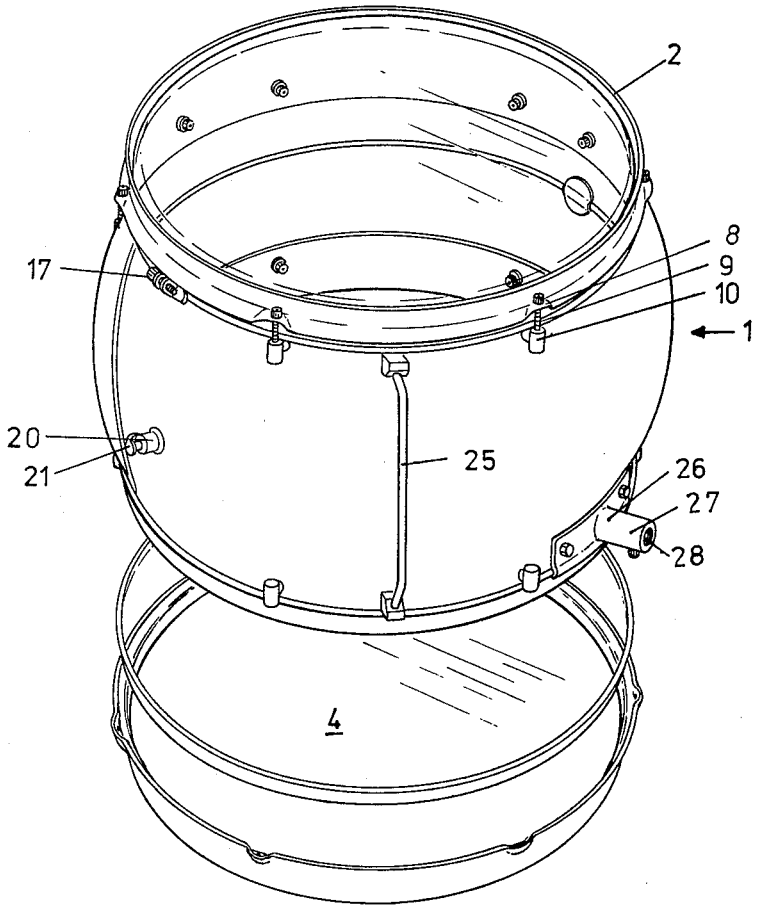
FIG. 1 shows a perspective view of a drum according to the invention the lower skin being shown in exploded view.
Figure 2:
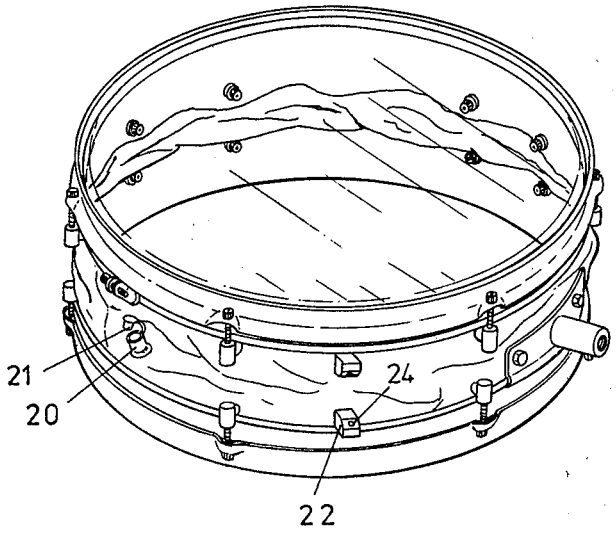
FIG. 2 shows the drum in its collapsed condition.
Figure 3:
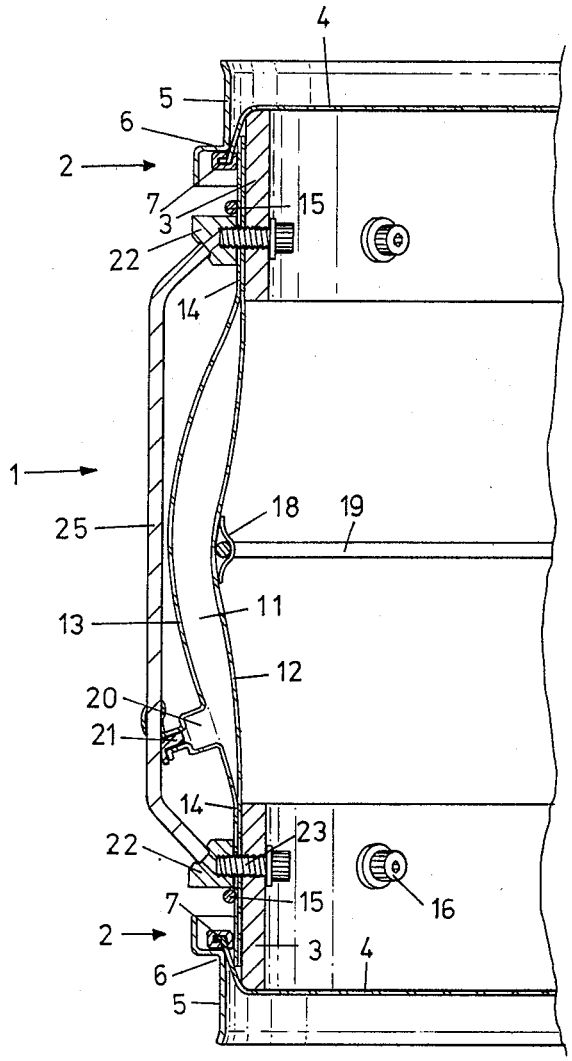
FIG. 3 shows a partial cross-section of the drum.

The drum 1 includes ends 2, each of the ends 2 being similar in construction. Each end includes a ring 3 over which a skin 4 is stretched. Each skin may be of premoulded construction and held in position and tensioned by hoop 5 which has a shoulder 6 engaging a bead 7 on the skin 4. The skins shown are transparent but other forms of skin may be used.

Each hoop 5 has a formed portion 8 having an aperture through which a tensioning stud 9 can pass to be screwed into a boss 10, which is in turn screwed or bolted as at 16 to the ring 3.

The wall of the drum is a hollow inflatable wall 11 having an inner wall 12 and an outer wall 13. The two walls 12 and 13 are joined and united to each other at the edges or flanges 14, the flanges being held and attached to the ring 3 by a tension wire 15 having tension screw 17.

The flexible wall 11 can be formed of any suitable flexible material, such as vinyl, rubber, or other suitable flexible inflatable material. The inner wall 12 is provided with spaced loops 18 to retain a stabilizing wire 19 which prevents undue expansion inwardly to maintain the general clear uninterrupted space or volume inside the drum to allow the free vibration and air vibration movement inside the drum with a generally parallel wall sided drum.

The inflatable wall 11 has an inlet valve and plug 20 of known form whereby after inflation, which may be by human breath, the plug 21 is inserted.

Sockets 22 are screwed or bolted by screw 23 to the rings 3, each socket 22 having an aperture 24 to receive a strut 25 to hold and stabilize the drum in its erected position.

A mounting bracket 26 is provided on one ring 3 to have a stem 27 adapted to engage some support stand to hold the drum in position. This stem 27 has a hole 28 passing through the ring 3 into the interior of the drum. This allows air to pass therethrough as the drum is collapsed and erected.

On erection by inflating the wall, the struts 25 finally tension and support and stabilize the drum. The invention achieves a clear uninterrupted volume inside the drum, thus giving no impediment to the vibrations of air in the drum. Also the side walls of the interior of the drum are generally parallel which also is desirous of such drums. In fact it has been considered that the tonal qualities of the drum are improved this being due apparently to the inflated and slightly pressurized side walls of the drum.

In an alternative form of the invention, there is provided a flexible shell or wall, the wall having longitudinal hollow ribs spaced around its circumference. This flexible shell can be formed of rubber, vinyl or other suitable flexible and air impermeable material and can comprise the plurality of longitudinal hollow ribs which can be inflated to cause the ribs to be either rigid or semi-rigid. The ribs are preferably joined at at least one end by a circumferential hollow header rib, so that by inflating the ribs and header, the ribs become rigid or semi-rigid to a certain degree to hold the drum in the erected condition.

Thus the upper and lower drum skins can be attached and tensioned in the normal manner, and the ends of the drum are joined by the flexible shell. The shell can be made of a vinyl material or rubber material, and can be provided by having two layers of the material with the channels and ribs being formed by heat sealing or otherwise uniting or gluing the two portions together in the desired configuration to form the interconnected ribs and header.

A simple air valve can be provided and if desired a simple pump, either hand or foot operated can be connected to the air valve and by actuating the pump the pressure in the ribs will be sufficient to erect the drums and hold the drums in the erected position.

Thus it will be seen that merely by inflating and deflating the units, the drum stand can be readily erected and collapsed so that it is relatively easy to transport and store the drum or percussion kit the total volume required for such transporation or storage being only a fraction of that compared with standard percussion kits. The invention can be applied to all forms of drums, ranging from base drums, to snare and side drums.

Although one form of the invention has been described in some detail it is to be realized that the invention is not to be limited thereto but can include various modifications falling within the spirit and scope of the invention.

I claim:

1. A percussion instrument having an upper playing surface supported by an upper ring, a lower ring, and a wall interconnecting said rings, characterized in that said wall comprises a flexible inflatable wall, and means to admit air to said inflatable wall to pressurize the wall for erection, and release said air for said wall to collapse to move said rings toward each other for transport and storage.

2. A percussion instrument as defined in claim 1, characterized in that said inflatable wall comprises a pair of parallel walls united at their upper and lower ends, and clamping means to connect said upper and lower ends to said rings.

3. A percussion instrument as defined in claim 2, characterized in that each said ring includes socket means to receive strut members to tension and stabilize the drum in erected condition.

4. A percussion instrument as defined in claim 2, characterized in that there is provided a central stabilizing ring on the inner wall of the inflatable wall to maintain the inner wall generally parallel to the outer wall, said inflatable wall being secured to said rings by a tension wire.

* * * * *